United States Patent [19]

Kikuchi

[11] 4,362,011

[45] Dec. 7, 1982

[54] FALSE-TWISTING EQUIPMENT

[75] Inventor: Syuichi Kikuchi, Kyoto, Japan

[73] Assignee: Murata Kikai Kabushiki Kaisha, Japan

[21] Appl. No.: 206,552

[22] PCT Filed: Dec. 22, 1979

[86] PCT No.: PCT/JP79/00322

§ 371 Date: Aug. 25, 1980

§ 102(e) Date: Aug. 22, 1980

[87] PCT Pub. No.: WO80/01289

PCT Pub. Date: Jun. 26, 1980

[30] Foreign Application Priority Data

Dec. 25, 1978 [JP] Japan ..... 53-165009

[51] Int. Cl.[3] ..... D02G 1/02

[52] U.S. Cl. ..... 57/291; 57/352

[58] Field of Search ..... 57/282, 284, 290, 291, 57/308, 352

[56] References Cited

U.S. PATENT DOCUMENTS

| | | | |
|---|---|---|---|
| Re. 30,159 | 11/1979 | Kubler | 57/291 |
| 3,782,890 | 1/1974 | Howorth | 57/308 X |
| 3,791,121 | 2/1974 | Ernst | 57/291 X |
| 3,971,201 | 7/1976 | Hartig | 57/352 X |
| 4,106,274 | 8/1978 | Eaves | 57/291 |
| 4,201,036 | 5/1980 | Shellenberg et al. | 57/291 |

*Primary Examiner*—Donald Watkins

*Attorney, Agent, or Firm*—Whittemore, Hulbert & Belknap

[57] ABSTRACT

False-twisting equipment including a first heater disposed on one side of an operation space, a second heater disposed on the other side of an operation space and a balloon control device and a false-twisting spindle disposed in the upper portion of the operation space wherein yarn is fed from the one side through the upper portion of the operation space and wound on the other side and the yarn passes through the upper portion of the operation space in a straight line so as to effectively propagete false-twists given to the yarn by the false-twisting spindle. The yarn, and the first heater are disposed as close to the floor as possible and the height of the top of the heater is lowered as much as possible, so that the yarn coming from the first heater to the false-twisting spindle is bent at a bending angle as large as possible.

In order to reduce the frequency of occurrence of yarn breakage at the start of operation, guide pins for guiding the yarn are mounted on the top end of a vertically movable operation rod in the upper portion of the first heater, and at the time of starting the travel of the yarn, the operation rod is brought down to cause the yarn to fall into engagement with a guide pin located below the top of the first heater.

3 Claims, 2 Drawing Figures

FALSE-TWISTING EQUIPMENT

TECHNICAL FIELD

This invention relates to false-twisting equipment. More particularly, the invention relates to false-twisting equipment which comprises a yarn feed bobbin and heater disposed on one side of an operation space and a winding device disposed on the other side of the operation space, wherein a yarn to be processed is travelled from one side of the operation space to the other side of the operation space while passing through the upper portion of the operation space and the yarn is subjected to a treatment such as false-twisting under heating during this travel.

BACKGROUND ART

In false-twisting equipments, the length of a yarn heater has been increased with elevation of the yarn travelling speed. In the case where a yarn taken out from a yarn feed bobbin is passed through a vertical first heater, there is often adopted a method in which after the yarn is taken out from the upper portion of the vertical first heater, the moving direction of the yarn is changed by a guide pin and is transferred to the opposite side of an operation space. The yarn is false-twisted by a false-twisting device disposed in the upper portion of the operation space. In false-twisting equipment of this type, the first heater has a certain length determined depending on the yarn speed and heater temperature required for setting twists, and the height of this heater is much larger than the height of a second heater or winding device disposed on the opposite side of the operation space. Accordingly, the bending angle of the yarn bent toward the operation space in the upper portion of the first heater becomes acute, with the result that propagation of twists is inhibited and the yarn speed has to be controlled to a low level.

In this false-twisting equipment, a false-twisting spindle, a balloon control device, a cooling device and the like are disposed to treat the yarn which passes across the operation space in the upper portion thereof. Unless the yarn passes through these devices substantially in a straight line, the yarn quality is degraded.

The above-mentioned yarn guide pin disposed in the upper portion of the first heater is contaminated by smoke formed from the heated yarn and rising and escaping from a preheater and also contaminated by the yarn which is brought into frictional contact with the guide pin. If the yarn is hung on such contaminated guide pin and travelling of the yarn is started, the yarn is readily broken by a large frictional force produced at the point of contact between the guide pin and yarn.

DISCLOSURE OF INVENTION

In the false-twisting equipment of the present invention, respective devices are arranged in a reverse U-shaped region surrounding an operation space. A first heater is vertically disposed on one side of the operation space and a winding device is vertically disposed on the other side of the operation space, while the operation space is interposed between the first heater and the winding device. A creel is arranged behind the first heater and a second heater is arranged behind the winding device.

A yarn taken out from the creel is heated by the first heater and is bent in the upper portion of the first heater, and the yarn is passed through the upper portion of the operation space and is guided into the second heater from the upper portion thereof. While the yarn is being passed through the operation space, the yarn is cooled by a cooling device disposed in the upper portion of the operation space,and the yarn is false-twisted by a false-twisting device while ballooning is inhibited by a balloon control device.

The yarn is advanced in a straight line in the upper portion of the operation space, and by this straight advance of the yarn, propagation of twists in the linear portion is uniformalized and the yarn speed, therefore, can be increased. Furthermore, since the first heater is vertically disposed, smoke is smoothly discharged upward and contamination of the yarn-contacting surface is reduced. Accordingly, the frequency of exchange of yarn-contacting surfaces can be reduced. Moreover, all the elementary devices can be arranged within the reach of hands of an operator standing in the operation space and the operation efficiency can be enhanced.

In order to reduce the acuteness of the bending angle of the yarn which has been advanced in the upper portion of the operation space from the first heater, the height of the top of the first heater is decreased. However, since the first heater should have a length beyond a certain limit, the first heater is disposed as close to the floor as possible. If the bending turn-up angle of the yarn is thus increased, inhibition of propagation of twists imparted to the yarn by the false-twisting device at the bending part is remarkably moderated, and the twisting efficiency can be increased.

Above the outlet of the first heater, the yarn is guided by a guide pin. This guide pin is mounted on the top end of an operation rod guided vertically movably by a guide tube, and when the guide pin is brought down, also the yarn located in the upper portion of the operation space is brought down while being guided by the guide pin and is caused to fall in engagement with a guide pin located below the top of the first heater. Accordingly, the guide pin with which the yarn is contacted at the time of starting the winding operation is not contaminated with smoke rising from the heater, and hence, the guide pin is smoothly rotated and a trouble such as yarn breakage is not caused at all. After travel of the yarn has been completely initiated, the operation rod is elevated and also the guide pin integrated with the operation rod is elevated above the first heater.

BEST MODE FOR CARRYING OUT THE INVENTION

Figure 1:
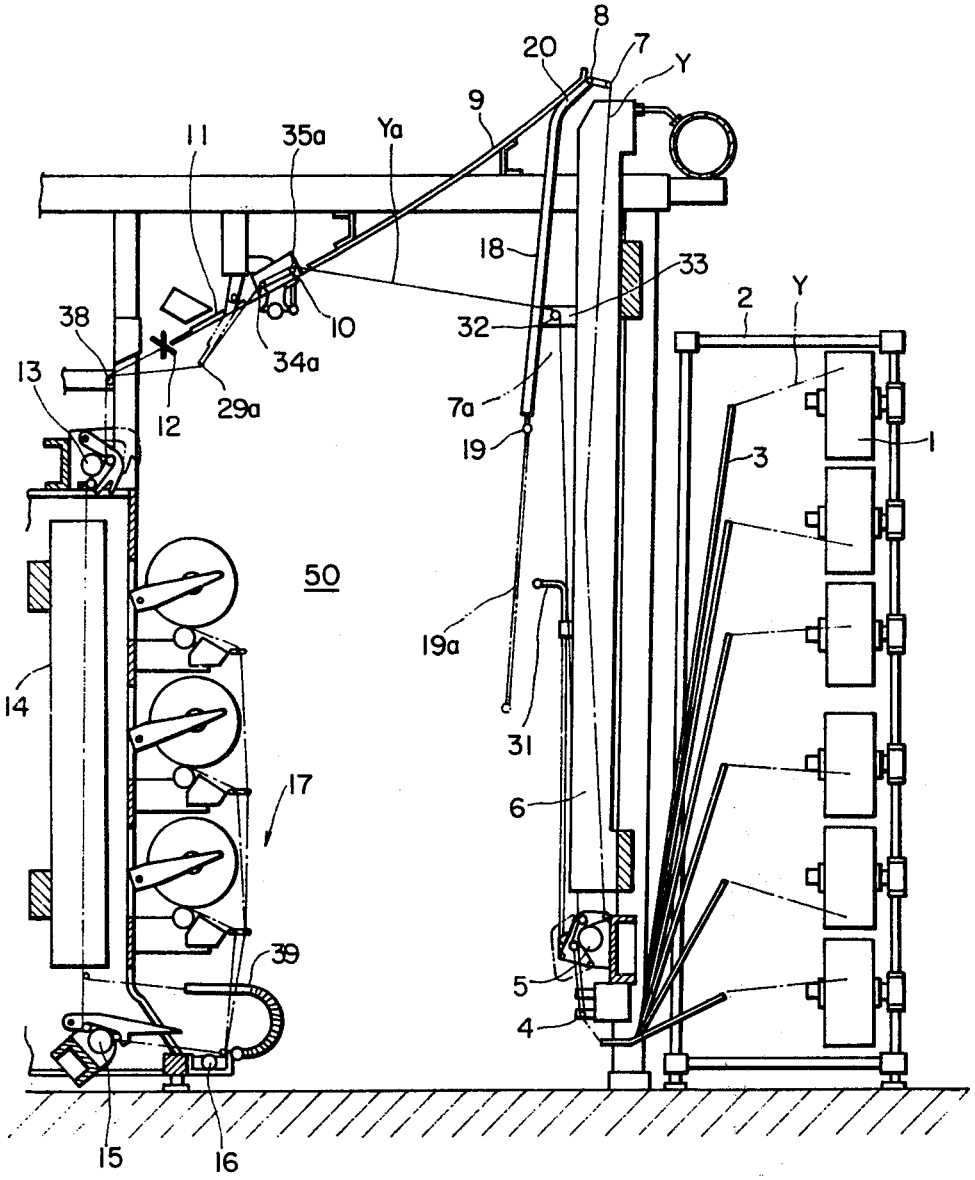
FIG. 1 is a front view illustrating the false-twisting equipment according to the present invention.

Reference numeral (50) represents an operation space in the false-twisting equipment according to the present invention, and respective elementary devices are arranged in a reverse U-shaped region surrounding the operation space (50).

A first heater (6) is vertically disposed on one side of the operation space (50) and a winding device (17) is vertically disposed on the other side of the operation space (50). A creel (2) supporting a plurality of yarn feed bobbins (1) is arranged behind the first heater (6)

and a second heater (14) is arranged behind the winding device (17). A cooling plate (9), a cooling device (10), a balloon control device (11) and a false-twisting spindle (12) are arranged in the upper portion of the operation space (50) between the upper portion of the first heater (6) and the upper portion of the second heater (14) so that a yarn Y can be guided in a straight line through these devices.

A plurality of yarn guide tubes (3) are mounted in front of the corresponding yarn feed bobbins (1) supported on the creel (2). The lower end of each yarn guide tube (3) is opened in the vicinity of the lower end of the first heater (6) in the lowermost portion of the equipment to guide the yarn Y on the corresponding yarn feed bobbin (1) to the lower end of the first heater (6). A tension device (4) and a first delivery roller (5) are arranged between the lower end of the yarn guide tube (3) and the lower end of the first heater (6). The first heater (6) is located above these devices, and the first heater (6) is brought close to the floor so that the position of the first heater (6) is as low as possible. Reference numeral (31) represents an operation rod for opening and closing the first delivery roller (5). A guide tube (18) is supported on the front face of the first heater (6) by a supporting piece (33). An operation rod (19) having a lever 20 formed on the top end thereof, said lever (20) including movable guide pins (7) and (8), is fitted and inserted in the guide tube (18), so that when the operation rod (19) is drawn, the movable guide pins (7) and (8) are located below a stationary guide pin (32) mounted on the supporting piece (33). In the embodiment illustrated in the drawings, two movable guide pins (7) and (8) having a small diameter are disposed, but instead of these two guide pins (7) and (8), one movable guide pin having a large diameter may be arranged.

Reference numerals (38), (13), (15), (16) and (39) represent a guide pin, a second delivery roller, a third delivery roller, an oiling device and a suction device, respectively.

The cooling device (10) will now be described in detail.

The cooling device (10) comprises a body member (21) and a cover plate (22), and in this cooling device (10), the yarn Y is passed through water flowing from a water feed pipe (23) mounted on the body member (21) to a water discharge pipe (24) whereby the yarn Y is cooled. Guide pins (34) and (35) are mounted on the lower face of the cover plate (22), so that when the cover plate (22) is opened, the pins (34) and (35) are placed in the horizontal state and the yarn Y in the body member (21) can be scooped out and taken out from the body member (21).

The balloon control device (11) comprises a balloon controlling plate (28) fixed to an arm (27) supported on a stationary bracket (25) by means of a pin (26).

Another arm having a yarn guide (29) mounted on the top end thereof is secured to the arm (27).

Figure 2:
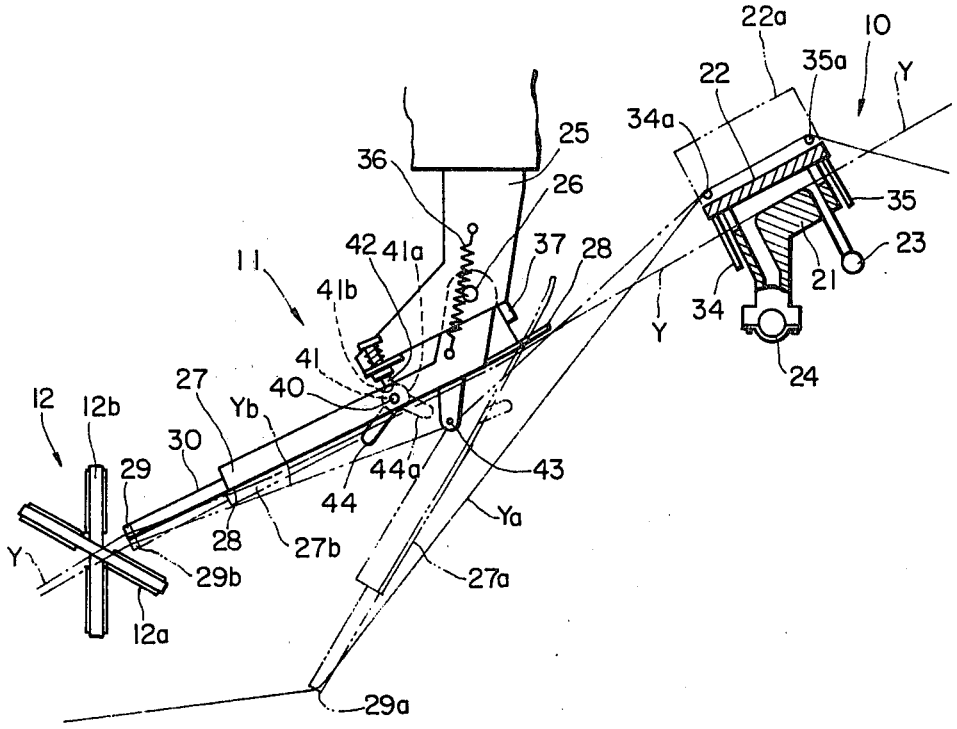
FIG. 2 is a front view illustrating in detail a cooling device and a balloon control device in the false-twisting equipment according to the present invention.

A spring (36) connecting the bracket (25) to the arm (27) in the balloon control device (11) is located at the position, shown in FIG. 2 to urge the arm (27) in the clockwise direction around the pin (26). When the arm (27) is turned to the position (27*a*) indicated by a chain line beyond the maximum stretch state of the spring (36), the pin (26) is shifted to the right in FIG. 2, with the result that the urging direction of the spring (36) is reversed and the arm (27) is urged in the opposite direction, that is, in the counterclockwise direction. A projection (37) is formed on the bracket (25) so that when the arm (27) is turned, the arm (27) abuts against this projection (37) and the arm (27) is thus fixed by the projection (37). A cam (41) is mounted on the arm (27) so that the cam (41) can turn integrally with a lever (44) with a shaft (40) being as the center. The cam (41) comprises an arcuate portion (41*a*) and a level portion (41*b*). An adjust bolt (42) is secured at the position confronting the cam (41) by means of the stationary bracket (25).

The false-twisting spindle (12) comprises two running endless belts (12*a*) and (12*b*), and the yarn Y is nipped between both the belts and is thus false-twisted.

In the false-twisting equipment having the above-mentioned structure, the yarn Y taken out from the yarn feed bobbin (1) is passed through the yarn guide tube (3), the tension device (4), the first delivery roller (5), the first heater (6), the yarn guide pins (7) and (8), the cooling plate (9), the cooling device (10), the balloon control device (11), the false-twisting spindle (12), the second delivery roller (13), the second heater (14), the third delivery roller (15) and the oiling device (16), and is wound on the winding device (17).

At the yarn-hanging operation, the operation rod (19) is brought down to the lower position (19*a*) and the cover plate (22) of the cooling device (10) is opened at the open position (22*a*), and the arm (27) of the balloon control device (11) is located at the position (27*a*) and both the first delivery roller (5) and the second delivery roller (13) are opened. At this point, the movable guide pin (7) is located below the stationary guide pin (32) as indicated by (7*a*) in the drawings, and the guide pins (34) and (35) are located at the positions (34*a*) and (35*a*) shown in FIGS. 1 and 2. The guide (29) of the balloon control device (11) is located at the position (29*a*) shown in FIGS. 1 and 2. The yarn Y taken out from the yarn feed bobbin (1) is passed through the tension device (4) and hung on the guide pin (32), guide pins (34*a*) and (35*a*), guide (29*a*) and guide pin (38) as indicated by a solid line Ya in FIG. 1, and the yarn Y is passed through the second heater (14) and sucked and held by the suction tube (39). At this point, the yarn Ya is not brought in contact with any of the first heater (6), the cooling plate (9) and the balloon controlling plate (28).

In this state, the second delivery roller (13) is closed, and the yarn which has been kept stationary is caused to begin to run. At this point, since the stationary guide pin (32) is disposed in the front of the first heater (6), the stationary guide pin (32) is not contaminated with smoke from the first heater (6). Furthermore, since the yarn is separated from running water of the cooling device (10) by the guide pins (34*a*) and (35*a*) and the yarn is not brought in contact with any of the first heater (6), the cooling plate (9) and the balloon controlling plate (28) as pointed out hereinbefore, the area which falls in contact with the yarn is very small and the static friction of the yarn-contacting area is very small. Accordingly, occurrence of yarn breakage at the start of travelling of the yarn can be prevented.

After travelling of the yarn has been thus started, the lever (44) is turned to the position (44*a*) shown in FIG. 2 and the arm (27) is turned from the position (27*a*) in the clockwise direction. At this point, the spring (36) goes beyond the maximum stretch point, and therefore the spring (36) begins to urge the arm (27) in the clockwise direction. Accordingly, the arcuate portion (41*a*) of the cam (41) is caused to abut against the adjust bolt (42) supported on the bracket (25), whereby the arm (27) is secured at the position (27*b*) and the yarn guide

(29) is located at the position (29*b*). At this point, the yarn is bent and guided by the pin (43) integrally fixed to the arm (27) but is still prevented from falling in contact with the balloon controlling plate (28) as indicated by Yb in FIG. 2. However, the yarn is brought into contact with one or both of the false-twisting belts (12*a*) and (12*b*) in the vicinity of the nip point of the false-twisting belts (12*a*) and (12*b*) by means of the yarn guide (29*b*), and the yarn is false-twisted at a twist number smaller than the twist number in the normal false-twisting operation (hereinafter referred to as "half-twisted state"). If this half-twisted state is thus brought about, the frictional force at the yarn-contacting point is remarkably reduced, but a predetermined tension is given to the running yarn by closing the first delivery roller (5) in this half-twisted state.

Then, the operation rod (19) is raised, and the yarn hung on the stationary guide pin (32) is picked up by the movable guide pins (7) and (8) and is guided to the position Y from the position Ya in FIG. 1. The yarn is thus introduced into the preheater (6) and brought into contact with the cooling plate (9).

Then, the cover plate (22) of the cooling device (10) is closed to dip the yarn in cooling water, and simultaneously, the yarn is taken out from the pin (43) and brought into contact with the balloon controlling plate (28). Then, the lever (44) is turned from the position (44*a*) to the position (44) in FIG. 2, whereby the level portion (41*b*) of the cam (41) is caused to abut against the bolt (42) and the yarn guide (29) is shifted to the position (29) from the position (29*b*). Thus, the yarn is guided to the center of the contact area between the false-twisting belts (12*a*) and (12*b*) and the yarn is false-twisted at a predetermined whole twist number. At this normal twisting operation, the yarn Y is advanced substantially in a straight line along the course extending from the guide pin (8) to the guide pin (38).

Then, the yarn is passed through the third delivery roller (15) and the oiling roller (16) and introduced into the winding device (17).

INDUSTRIAL APPLICABILITY

In the false-twisting equipment according to the present invention, false twists given to a yarn by a false-twisting spindle in the process for the manufacture of a processed yarn can be conveniently propagated to the first heater, and therefore, the yarn quality is effectively improved.

Furthermore, the false-twisting equipment according to the present invention makes a great contribution to the improvement of the yarn speed, and also in this point, the present invention is industrially advantageous

I claim:

1. False-twisting equipment comprising a first heater vertically disposed on one side of an operation space including a guide pin located in the upper portion thereof, a yarn feed bobbin also located on the one side of the operation space, a second heater vertically disposed on the other side of the operation space, a winding device also located on the one side of the operation space, and a balloon control device and false-twisting spindle disposed in the upper portion of the operation space, wherein a yarn coming from the first heater may be bent by the guide pin located in the upper portion of the first heater and fed to the false-twisting spindle and then passed through the second heater and wound on the winding device, said balloon control device and false-twisting spindle being arranged in a straight line whereby yarn passing through said balloon control device and false-twisting spindle travels substantially in a straight line in the upper portion of the operation space and said first heater being located close to the floor whereby the yarn passing through the upper portion of the operation space has an angle as large as possible with respect to the first heater.

2. False-twisting equipment as set forth in claim 1, including means for vertically moving the guide pin comprising a guide member supported adjacent said first heater, an operation lever having an upper end supported by the guide member for vertical movement and a guide pin supporting lever mounted on the upper end of the operation lever.

3. False-twisting equipment as set forth in claim 2 and further including a stationary guide pin disposed at a position below the top of the first heater, below the position of the vertically movable guide pin with the supporting lever in an upper most vertical position and above the position of the vertically movable guide pin with the supporting lever in a lower most vertical position, whereby when the movable guide pin is brought down, yarn supported by the movable guide pin falls in engagement with the stationary guide pin.

* * * * *